United States Patent [19]

Wullsehleger et al.

[11] Patent Number: 4,638,627

[45] Date of Patent: Jan. 27, 1987

[54] WRISTLET HAVING LINKS

[75] Inventors: Andreas Wullsehleger, Lengnau; Othmar Brunner, Langendorf, both of Switzerland

[73] Assignee: ETA SA Fabriques d'Ebauches, Grenchen, Switzerland

[21] Appl. No.: 736,738

[22] Filed: May 22, 1985

[30] Foreign Application Priority Data

Jun. 8, 1984 [FR] France ..... 84 09177

[51] Int. Cl.[4] ..... F16G 13/00

[52] U.S. Cl. ..... 59/80; 63/4; 63/7

[58] Field of Search ..... 59/78, 80, 82, 84; D11/4; 63/3, 4, 7, 10

[56] References Cited

U.S. PATENT DOCUMENTS 1,214,135 1/1917 Clark ..... 59/80

3,857,237 12/1974 Brauchi ..... 59/80

FOREIGN PATENT DOCUMENTS 269271 5/1951 Switzerland ..... 59/80

558153 6/1972 Switzerland .

*Primary Examiner*—Lowell A. Larson

*Assistant Examiner*—David B. Jones

*Attorney, Agent, or Firm*—Pollock, Vande Sande & Priddy

[57] ABSTRACT

The wristlet is primarily intended for watches and comprises a succession of links (10) hingedly connected to each other by connection elements (12) such as to enable the links (10) to pivot about the hinge axis (14). Each connecting element (12) comprises two parts (16, 18) secured, respectively, to two adjacent links, with each part having a pair of male members (22, 24; 34, 36) and a pair of female members (26, 28; 30, 32), said male and female members being interengaged with each other. The male members (22, 24) of one of the parts are generally cylindrical with their axis providing the hinge axis (14), while the male members (34, 36) of the other part are generally parallelepipedic. The bordering region between adjacent links is substantially co-planar with a line of contact between the male members of their connecting element.

13 Claims, 8 Drawing Figures

WRISTLET HAVING LINKS

BACKGROUND OF THE INVENTION

This invention relates to wristlets having hinged links, in particular for use with watches.

Such wristlets, generally made of metal, are appreciated for their strength. Unfortunately, they are expensive because of their complexity.

SUMMARY OF THE INVENTION

An object of the invention is to provide a wristlet having links, which requires few constituent parts and which is easy to produce and to assemble.

To this end the connection between two adjacent links is provided by an element comprising a pair of parts respectively secured to the two links, each part comprising a male member and a female member, the male member of each part cooperating with the female member of the other part. Also, one of the male members of each connection element is cylindrical while the other male member is parallelepipedic. The two parts are each partly covered by the two adjacent links and the parallelepipedic male member is relieved in the region thereof contiguous to the link that is secured to the part comprising the cylindrical male member.

DETAILED DESCRIPTION

Figure 1:
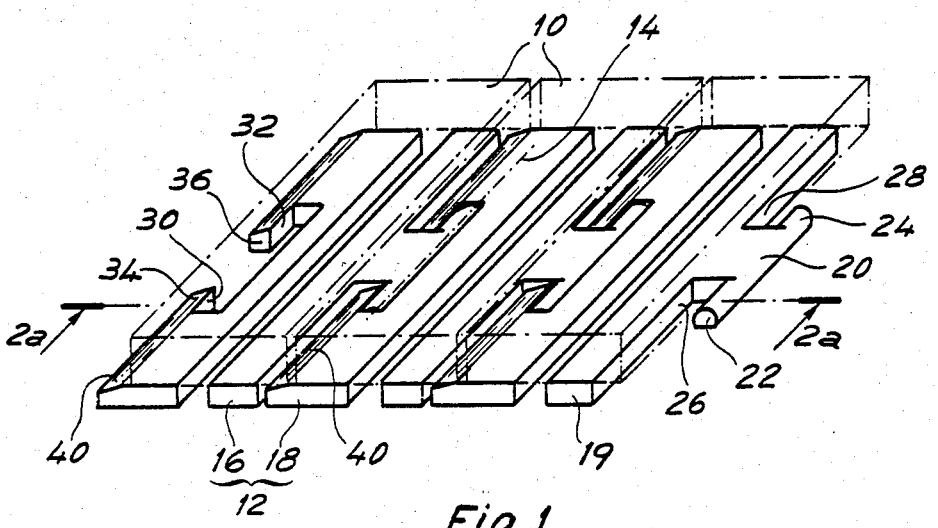
FIG. 1 is a perspective view of a portion of a first form of embodiment of the wristlet according to the invention.

In the several figures, similar portions have been given the same reference numerals.

Figure 2A:
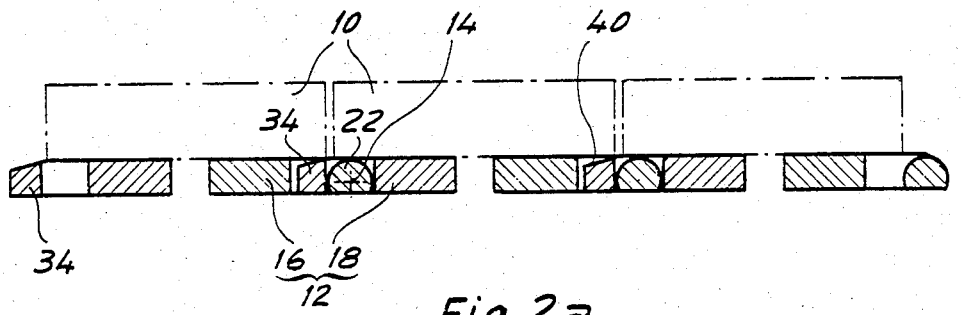
FIG. 2*a* is a longitudinal section along line 2*a*—2*a* of the wristlet portion shown in FIG. 1.
Figure 2B:
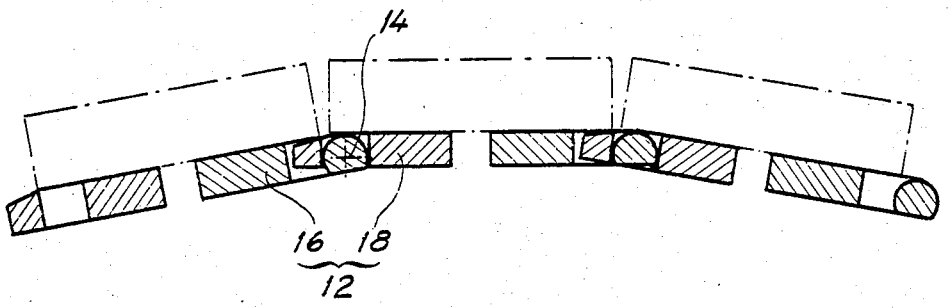
FIG. 2*b* is a view similar to that of FIG. 2*a* in a somewhat flexed condition.

The wristlet partly shown in FIGS. 1, 2*a* and 2*b* comprises a succession of links 10 consisting of parallelepipedic plates and a succession of connection elements 12 connecting the links to each other and enabling them to pivot about hinge axes 14. Each element 12 is made up of two parts 16 and 18 that are respectively secured, as by welding, to the undersides of two adjacent links.

Figure 3:
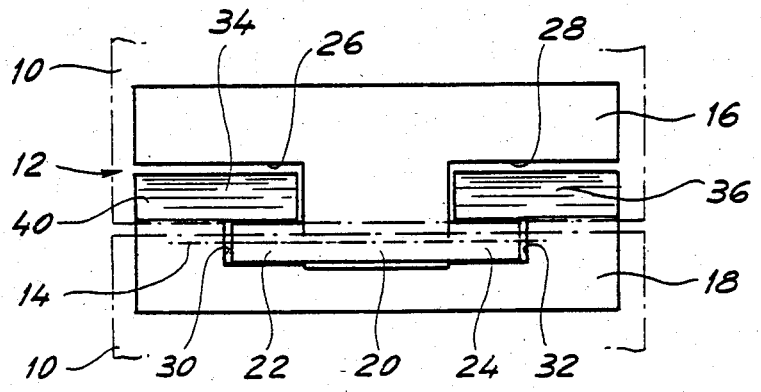
FIG. 3 is a plan view of a connection element used in the wristlet partly shown in FIG. 1.

As is more readily apparent from FIG. 3, part 16 is formed with a central, T-shaped, portion 20 which fits into an opening of complementary shape provided in part 18. The arms 22 and 24 of T-shaped portion 20 form a pair of male members while the spaces 26 and 28 between arms 22 and 24 and the body of part 16 form a pair of female members. The opening of complementary shape in part 18 includes spaces 30 and 32 forming a pair of female members which cooperate with the male members 22 and 24 of part 16, while fingers 34 and 36 along the outside of spaces 30 and 32 of part 18 respectively cooperate with the female members 26 and 28 of part 16.

Male members 22 and 24 of part 16 are cylindrical and their axes, which are perpendicular to the direction of alignment of links 10, define the hinge axis 14 of the connection between a pair of adjacent links. Male members 22 and 24 are fitted without play into female members 30 and 32 of part 18 but without however preventing pivotal motion thereof. Between the free ends of male members 34 and 36 and the bottoms of associated female members 26 and 28 the play is very slight to ensure proper alignment of the links.

The word "cylindrical" is to be interpreted broadly since only those portions of male members 22 and 24 that cooperate with the surfaces of female members 30 and 32 parallel to axis 14 and that cooperate with the undersides of links 10 need to be rounded to ensure proper operation of the hinge.

Unlike male members 22 and 24, male members 34 and 36 of part 18 are parallelipipedic. As is apparent from FIG. 2*b*, their play within female members 26 and 28 must be sufficient so as not to interfere with their pivotal motion.

As will be apparent from FIGS. 2*a*, 2*b* and 3, the positioning of links 10 in relation to parts 16 and 18 is such that the border region between two adjacent links 10 is substantially above the line of contact between male members 22 and 24, on the one hand, and male members 34 and 36, on the other hand. Thus, the male members 22 and 24 of a part 16 secured to one link are covered by the adjacent link. Similarly, the male members 34 and 36 of a part 18 secured to one link are covered by the adjacent link. Such an arrangement enables parts 16 and 18 of a connection element 12 connecting a pair of links 10 to be permanently secured to each other.

FIGS. 2*a*, 2*b* and 3 show also that male members 34 and 36 of part 18 are relieved with a bevel 40 (shaded in FIG. 3) in the region where it is covered by the link that bears part 16. Such a bevel is needed to enable a connection element 12 to pivot, the greater the slope of the bevel the greater the scope for pivotal motion.

The word "parallelepipedic" for male members 34 and 36 is also to be interpreted broadly since only two of the surfaces of male members 34 and 36 play an active role in the operation of the hinge, i.e. the surfaces cooperating with male members 22 and 24 in performing the function of the hinge and the surfaces forming bevel 40 and whose shape determines the amplitude of the hinge motion.

Figure 4:
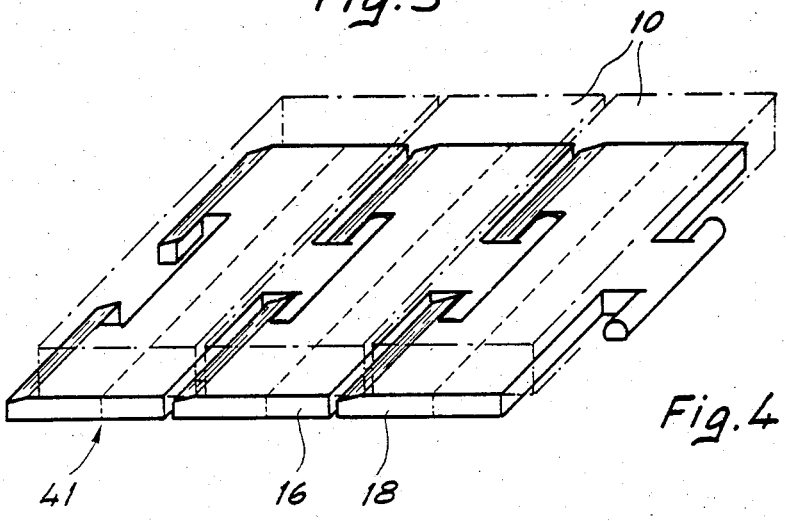
FIG. 4 is a perspective view of a portion of a second form of embodiment of the wristlet according to the invention.

In the form of embodiment described with reference to FIGS. 1 to 3, the parts 16 and 18 that are secured to a link 10 are separate. As shown in FIG. 4, both these parts can be joined to form a single plate 41 welded to the underside of the link.

Figure 5:
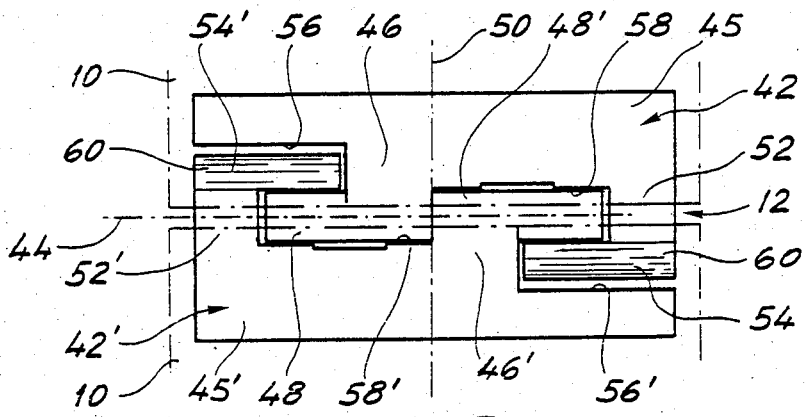
FIG. 5 is a plan view of a portion of a third form of embodiment of the wristlet according to the invention.

In the form of embodiment shown in FIG. 5, the wristlet also comprises a succession of links 10 and of connection elements 12. In this embodiment, a connection element 12 includes a pair of identical parts 42 and 42' that hinge about an axis 44 and that are respectively secured by welding to the undersides of the adjacent links. Part 42 has a first L-shaped portion comprising a pair of arms 46 and 48 at right angles to each other. The end of arm 46 adjoining arm 48 lies substantially on the mean line 50 of links 10. Arm 48 is cylindrical and its axis coincides with hinge axis 44.

The other half of part 42 has a second L-shaped portion comprising a pair of arms 52 and 54 at right angles to each other. The end of arm 52 adjoining arm 54 lies in the plane of the adjacent edge of part 42. Arm 54 is parallelepipedic and its inner edge is co-planar with the outer edge of arm 48.

Arms 48 and 54 form a pair of male members and the spaces 56 and 58 lying between arms 48 and 54 and the body of part 42 consitute a pair of female members.

Part 42' is strictly identical to part 42 and its various constituent portions bear the same reference numerals as the corresponding portions of part 42, with the addition of the sign '.

The male members 48 and 54 of part 42 are respectively accommodated in female members 58' and 56' of part 42', and male members 48' and 54' of part 42' are respectively accommodated in female members 58 and 56 of part 42.

Cylindrical male members 48 and 48' are fitted without play in female members 58' and 58 respectively. Sufficient play must be provided between parallelepipedic male members 54 and 54' and female members 56' and 56 respectively. Very liittle play is provided between the free ends of male members 54 and 54' and the bottoms of associated female members 56' and 56 to ensure proper alignment of links 10.

Parallelepipedic male members 54 and 54' are each formed with a bevel 60 (shaded in FIG. 5) whose function is identical to that of bevels 40 describe with reference to FIGS. 1 to 3.

In the FIG. 5 embodiment, links 10 are so positioned in relation to parts 42 and 42' that the bordering region between a pair of adjoining links 10 is substantially above the hinge axis 44. Thus, the parallelepipedic male member 54 of a part 42 secured to a link 10 is covered by the adjacent link 10. Similarly, the male member 54' of a part 42' secured to a link 10 is covered by the adjacent link 10.

In the FIG. 5 embodiment also, parts 42 and 42' which are secured to a common link 10 may consist of a single plate as described with reference to FIG. 4.

Figure 6A:
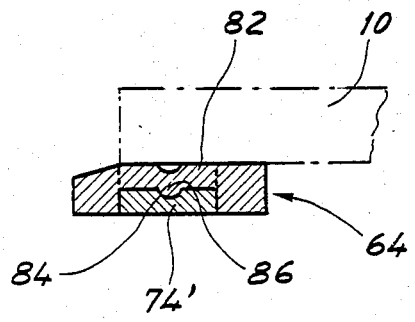
FIGS. 6*a* and 6*b* are respectively a cross-sectional view and a plan view of a portion of a fourth form of embodiment of the wristlet according to the invention, the cross-section being taken along line 6*a*—6*a* of FIG. 6*b*.
Figure 6B:
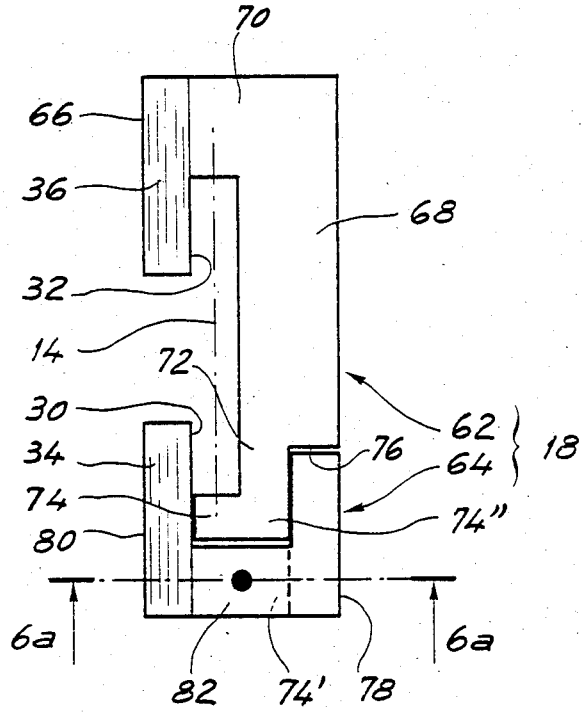

In all forms of embodiment so far described, the assembly cannot be dismantled once parts 16 and 18 have been welded to their respective link 10. FIGS. 6*a* and 6*b* show a part 18 that enables a connection element to be dismantled, thereby making it possible to modify the length of one strand of the wristlet when the latter includes several such parts.

To this end, part 18 has a pair of components 62 and 64 that can be separated from each other. Male member 36 and female member 32 are provided on component 62, male member 34 is provided on component 64 and female member 30 is defined partly by component 62 and partly by component 64.

As shown in FIG. 6*b*, component 62 has a first, U-shaped, region formed by three arms 66, 68 and 70, arms 66 and 68 being parallel to each other and joined by arm 70 which is at right angles to arms 66 and 68. Arm 66 forms male member 36 and the inner space of the U forms female member 32.

Component 62 has a second, L-shaped, region formed by two arms 72 and 74 by lying at right-angles to each other. Arm 72 is integral with arm 68. Between them they form a shoulder 76, arm 72 being narrower than arm 68. Arm 74 is parallel to arm 70 and has the same length. As shown in FIG. 6*a*, arm 74 has an outer portion 74' and an inner portion 74'', outer portion 74' being thinner than inner portion 74'' so as to leave a space between link 10 and portion 74' when link 10 is secured to part 16.

Component 64 is U-shaped and has a pair of parallel arms 78 and 80 connected by an arm 82. Arm 78 is adjacent arm 72 and its width is such that its outer side is in alignment with the outer side of arm 68.

Arm 80 forms male member 34 and is in alignment with arm 66. Arm 82 is at right angles to arms 78 and 80 and connects them. Thicknesswise, arm 82 lies between link 10 and portion 74' and entirely fills the intervening space (FIG. 6*a*). Arm 82 is also formed with a boss 84 on its surface adjacent portion 74' and the latter is formed with a cavity 86 in its surface adjacent arm 82 for receiving boss 84.

Female member 30 is defined by the inner surfaces of the L-shaped region and by the distal portion of the inner surface of arm 80.

Part 18 is secured to link 10 by welding thereto component 62, component 64 being held in place by a clamping action between portion 74' and link 10.

A comparison of FIGS. 3 and 6*b* shows that the two-component part 18 of FIG. 6*b* has the same outline as the monolithic part 18 of FIG. 3. Thus, the manner in which parts 16 and 18 cooperate remains the same.

To dismantle a connection element having a part 18 as shown in FIGS. 6*a* and 6*b*, in order to shorten or to lengthen the wristlet, it suffices to separate component 64 from component 62 by, for instance, inserting a screw-driver between arm 78 and arm 68, causing boss 84 to be dislodged from cavity 86 and enabling component 64 to move in a direction parallel to hinge axis 14 until arm 82 is fully extracted. When component 64 is removed, the unit consisting of the part 16 that is engaged in the dismantled part 18, and of the link 10 to which it is secured may rotate about an axis parallel to the direction of alignment of the links, male member 34 is no longer retaining link 10. Male member 22 then moves out of female member 30, thus enabling parts 16 and 18 of the connection element to be separated.

To reassemble parts 16 and 18 the opposite procedure is carried out.

In the described forms of embodiment, each one of parts 16 and 18 or 42 and 42' of an element 12 has two male members and two female members. Each part could however only have one male member and one female member. Thus, in the case of FIG. 3, male member 24 and female member 32 could be dispensed with. Central portion 20 would then be L-shaped and part 18 could be provided, in place of male member 36, with an abutment bearing against central portion 20.

The wristlet according to the invention is preferably made of stainless steel. This material provides the wristlet with excellent resistance to chemical attack and to wear yet lends itself to machining by stamping and to assembly by welding.

Other materials can of course also be used. For instance, for the links use could be made of hard materials such as corundum and titanium and tungsten nitrides and carbides. These materials are even more resistant to wear but are more difficult to machine.

To make the wristlet described with reference to FIG. 4, a strip of stainless steel is cut by a progressive swaging tool to produce plates 41. Each of the plates pressed out of the strip is assembled with the previously produced plate by inserting the male members of one plate into the female members of the other, thereby producing a hinged band. The connections between the various plates are sufficient for the band not to come apart under the effect of small shocks. This is because male members 22 and 24 are fitted without play in female members 30 and 32 respectively. Links 10 are also made by swaging, their topsides being treated to provide them with a surface condition that determines the aesthetic aspect of the wristlet. The links are then secured to plates 41 by electric welding after being positioned as previously described. This procedure enables a high degree of automation to be achieved thereby considerably reducing costs.

The described and illustrated arrangements enable a wristlet to be made in a particularly cheap manner, with resistant materials and with few parts.

We claim:

1. A wristlet comprising a succession of links and of hinged connection elements for hingedly connecting adjacent links to each other:

wherein each connection element has two parts, each of said parts having an upper face and a lower face and one of said parts being permanently secured by its upper face to one adjacent link and the other of said parts being permanently secured by its upper face to the other adjacent link;

wherein each of said two parts of the connection element has a male member and a female member, the male member of each part being received in and cooperating with the female member of the other part, the male member of one of said parts being generally cylindrical with an axis providing a hinge axis between said two parts, and the male member of the other of said parts being generally parallelepipedic;

wherein the upper faces of said two parts are each covered by a portion of each of the two adjacent links to prevent the male member of each part from moving out of the female member of the other part in the direction of said upper faces;

wherein the parallelepipedic male member of the other of said two parts of the connection element is relieved by a bevel in the region thereof contiguous to the link secured to the one of said two parts provided with the generally cylindrical male member to enable said two parts to pivot relative to each other about said hinge axis, the scope of said pivotal motion being defined by the slope of said bevel;

wherein a curved surface of said generally cylindrical male member contacts a substantially planar surface of said generally parallelepipedic male member along substantially a line of contact;

wherein each of said links comprises a plate each end of which in the direction of said succession of links has a substantially planar end face, the end faces of the plates of adjacent links being in opposed relation so as to define a border region between said plates positioned substantially above said line of contact;

wherein said generally cylindrical male member is fitted substantially without play into said cooperating female member and they play between adjacent links in the border region between said plates is sufficiently small that the male member of each part of said connection element is prevented from moving out of the female member of the other part in the direction of the lower faces of said two parts; and, wherein the lower faces of said connection element parts are exposed to form the bottom side of said wristlet.

2. A wristlet as in claim 1, wherein each element part is provided with a second male member having a shape similar to that of the first male member and with a second female member, said members being aligned in pairs in a direction parallel to said hinge axis.

3. A wristlet as in claim 1, wherein the element parts and the links are of stainless steel.

4. A wristlet as in claim 3, wherein the element parts are welded to the links.

5. A wristlet as in claim 1, wherein two element parts are secured to each link and are formed integrally by a plate, one end portion of which is provided with the male and female members of one of said two element parts and the other end portion of which is provided with the male and female members of the other of said two element parts.

6. A wristlet as in claim 2, wherein the element part having generally parallelepipedic male members has two components of which one forms with said link and undismantlable unit, said unit including assembly means cooperating with the other component to position the latter and enable it to be removed, each one of said two components having one of said generally parallelepipedic male members.

7. A wristlet as in claim 6, wherein said removable component is U-shaped and has a pair of parallel arms connected by a third arm at substantially right angles to said parallel arms, said third arm being thinner than said parallel arms so as to fit between the link secured to the upper face of said part having generally parallelepipedic male members and a correspondingly thin portion of said one component of the undismantlable unit.

8. A wristlet as in claim 7, wherein said third arm includes a first fastening element, and the thin portion of said one component of the undismantlable unit includes a second fastening element for engaging said first fastening element so as to detachably hold said removable component in position relative to said undismantlable unit.

9. A wristlet as in claim 8, wherein one of said fastening elements is a projecting boss and the other of said fastening elements is a cavity for receiving said boss.

10. A wristlet as in claim 1, wherein said generally parallelepipedic male member and said generally cylindrical male member each have a substantially planar lower face, the lower face of each of said two parts of the connection element is substantially planar, and said lower faces are substantially in the same plane when said wristlet lies substantially flat.

11. A wristlet comprising a succession of links and of hinged connection elements for hingedly connecting adjacent links to each other:

wherein each connection element has two parts, each of said parts having an upper face and a lower face and one of said parts being secured by its upper face to one adjacent link and the other of said parts being secured by its upper face to the other adjacent link;

wherein each of said two parts of the connection element has a male member and a female member, the male member of each part being received in and cooperating with the female member of the other part, the male member of one of said parts being generally cylindrical with an axis providing a hinge axis between said two parts, and the male member of the other of said parts being generally parallelepipedic;

wherein the lower faces of said two parts of the connection element are each uncovered and the upper faces of said two parts are each covered by a portion of each of the two adjacent links to prevent the male member of each part from moving out of the female member of the other part;

wherein the parallelepipedic male member of the other of said two parts of the connection element is relieved by a bevel in a region thereof contiguous to the link secured to the one of said two parts provided with the generally cylindrical male member to enable said two parts to pivot relative to each other about said hinge axis, the scope of said pivotal motion being defined by the slope of said bevel;

wherein each of said two parts of the connection element has a generally cylindrical male member, a generally parallelepipedic male member and two female members;

wherein each generally parallelepipedic male member has an inside surface in alignment with an outside surface of a corresponding generally cylindrical male member; and, wherein the two generally cylindrical male members of the connection element are contiguous and co-axial.

12. A wristlet as in claim 11, wherein the co-axial axes of said two generally cylindrical male members provide the hinge axis between said two parts of the connection element, and a bordering region between said two adjacent links is positioned substantially above said hinge axis.

13. A wristlet comprising a succession of links and of hinged connection elements for hingedly connecting adjacent likes to each other:

wherein each connection element has two parts, each of said parts having an upper face and a lower face and one of said parts being secured by its upper face to one adjacent link and the other of said parts being secured by its upper face to the other adjacent link;

wherein each of said two parts of the connection element has a male member and a female member, the male member of each part being received in and cooperating with the female member of the other part, the male member of one of said parts being generally cylindrical with an axis providing a hinge axis between said two parts, and the male member of the other of said parts being generally parallelepipedic;

wherein the lower faces of said two parts of the connection element are each uncovered and the upper faces of said two parts are each covered by a portion of each of the two adjacent links to prevent the male member of each part from moving out of the female member of the other part;

wherein the parallelepipedic male member of the other of said two parts of the connection element is relieved by a bevel in a region thereof contiguous to the link secured to the one of said two parts provided with the generally cylindrical male member to enable said two parts to pivot relative to each other about said hinge axis, the scope of said pivotal motion being defined by the slope of said bevel;

wherein each element part is provided with a second male member having a shape similar to that of the first male member and with a second female member, said members being aligned in pairs in a direction parallel to said hinge axis;

wherein the element part having generally parallelepipedic male members has two components of which one forms with said link an undismantlable unit, said unit including assembly means cooperating with the other component to position the latter and enable it to be removed, each one of said two components having one of said generally parallelepipedic male members; and, wherein said removable component is U-shaped and has a pair of parallel arms connected by a third arm at substantially right angles to said parallel arms, said third arm being thinner than said parallel arms so as to fit between the link secured to the upper face of said part having generally parallelepipedic male members and a correspondingly thin portion of said one component of the undismantlable unit.

* * * * *

UNITED STATES PATENT AND TRADEMARK OFFICE

CERTIFICATE OF CORRECTION

PATENT NO. : 4,638,627

DATED : Jan. 27, 1987

INVENTOR(S) : Wullschleger, et al.

It is certified that error appears in the above-identified patent and that said Letters Patent is hereby corrected as shown below:

On the first page of the patent, please change the applicant's name from "Wullsehleger" to --Wullschleger-- in each occurrence thereof.

In column 5, line 62, change "they" to --the--.

Signed and Sealed this

Twenty-first Day of April, 1987

*Attest:*

*Attesting Officer*

DONALD J. QUIGG

*Commissioner of Patents and Trademarks*